US007069122B1

(12) United States Patent
Higgs

(10) Patent No.: US 7,069,122 B1
(45) Date of Patent: Jun. 27, 2006

(54) REMOTE LOCOMOTIVE CONTROL

(75) Inventor: David B. Higgs, Bradford, PA (US)

(73) Assignee: Control Chief Corporation, Bradford, PA (US)

( * ) Notice: Subject to any disclaimer, the term of this patent is extended or adjusted under 35 U.S.C. 154(b) by 105 days.

(21) Appl. No.: 10/383,308

(22) Filed: Mar. 7, 2003

Related U.S. Application Data

(60) Provisional application No. 60/362,954, filed on Mar. 8, 2002.

(51) Int. Cl.
*G05D 1/00* (2006.01)
*G05D 3/00* (2006.01)

(52) U.S. Cl. ..... 701/19; 701/2; 701/20; 701/29; 246/167 R; 246/187 A

(58) Field of Classification Search ..... 701/2, 701/19–20, 23, 29, 32–33; 246/167 R, 182 R, 246/187 A, 187 C, 187 R; 340/3.1, 3.2, 340/3.21, 3.5, 825.2, 825.7–825.76, 825.21, 340/825.69, 825.38, 825.39, 825.52, 825.53; 455/450, 455, 451, 452.1, 452.2, 500–517; 370/328–337, 345–347, 503–504
See application file for complete search history.

(56) References Cited

U.S. PATENT DOCUMENTS 3,596,256 A * 7/1971 Alpert et al. ..... 710/45
4,217,643 A 8/1980 Anderson et al. ..... 701/20
4,582,280 A * 4/1986 Nichols et al. ..... 246/182 R
4,687,258 A 8/1987 Astley ..... 303/3
5,021,777 A * 6/1991 Gross et al. ..... 340/10.51
5,039,038 A * 8/1991 Nichols et al. ..... 246/3
5,164,985 A * 11/1992 Nysen et al. ..... 380/271
5,367,524 A * 11/1994 Rideout et al. ..... 370/324
5,420,883 A * 5/1995 Swensen et al. ..... 375/138
5,436,905 A * 7/1995 Li et al. ..... 370/346
5,450,409 A * 9/1995 Diaz et al. ..... 370/470
5,511,749 A 4/1996 Horst et al. ..... 246/187 A
5,685,507 A 11/1997 Horst et al. ..... 246/187 A
5,720,455 A * 2/1998 Kull et al. ..... 246/187 C
5,737,330 A * 4/1998 Fulthorp et al. ..... 370/346
5,890,682 A * 4/1999 Welk ..... 246/125
5,969,643 A * 10/1999 Curtis ..... 340/988
6,044,252 A * 3/2000 Dorenbosch ..... 455/161.1

(Continued)

OTHER PUBLICATIONS

Locomotive Control System, LCS—Beltpack, CN Rail; Sep. 1991; pp. 1-15.

(Continued)

*Primary Examiner*—Gertrude A. Jeanglaude
(74) *Attorney, Agent, or Firm*—The Webb Law Firm

(57) ABSTRACT

A locomotive control system includes an on-board controller responsive to a time signal received from a remote source for outputting a first polling signal at a time determined with reference to the time signal. A first remote controller is responsive to the polling signal for outputting a first control signal during a first interval of time. The on-board controller is responsive to the first control signal for controlling one or more functions of the locomotive. The locomotive control system can also include a second remote controller responsive to a second polling signal output by the on-board controller at a time after the first interval of time determined with reference to the time reference signal for outputting a second control signal during a second interval of time. The on-board controller is also responsive to the second control signal for controlling one or more functions of the locomotive.

19 Claims, 2 Drawing Sheets

U.S. PATENT DOCUMENTS 6,088,635 A * 7/2000 Cox et al. ..... 701/19
6,095,618 A * 8/2000 Heneka et al. ..... 303/3
6,229,452 B1 * 5/2001 Kull ..... 340/3.51
6,314,345 B1 * 11/2001 Coombes ..... 701/19
6,400,281 B1 * 6/2002 Darby et al. ..... 340/933
6,401,015 B1 * 6/2002 Stewart et al. ..... 701/19
6,434,458 B1 * 8/2002 Laguer-Diaz et al. ..... 701/35
6,449,536 B1 * 9/2002 Brousseau et al. ..... 701/19
6,487,478 B1 * 11/2002 Azzaro et al. ..... 701/24
6,505,103 B1 * 1/2003 Howell et al. ..... 701/19
6,789,004 B1 * 9/2004 Brousseau et al. ..... 701/19
2002/0115436 A1 * 8/2002 Howell et al. ..... 455/426
2003/0151520 A1 * 8/2003 Kraeling et al. ..... 340/825.72
2004/0100938 A1 * 5/2004 Aiken et al. ..... 370/346

OTHER PUBLICATIONS

BNSF General Code Of Operating Rules; Oct. 10, 1999; 23 pages.

* cited by examiner

REMOTE LOCOMOTIVE CONTROL

CROSS-REFERENCE TO RELATED APPLICATION

This application claims priority from U.S. Provisional Patent Application Ser. No. 60/362,954, filed Mar. 8, 2002, entitled "Improved Remote Locomotive Control".

BACKGROUND OF THE INVENTION

1. Field of the Invention

The present invention relates to a system for remotely controlling a locomotive.

2. Description of Related Art

In switching yards, it is desirable to have one or more ground-based operators controlling the movement of a locomotive. This is typically accomplished by each ground-based operator having a remote controller that communicates with an on-board controller located on-board the locomotive via a radio link. Typically, the operator carries the remote controller and manipulates knobs, buttons, switches and the like of the remote controller to control corresponding functions on the locomotive via the on-board controller and the radio link therewith.

It is often desirable in switching yards to have a ground-based operator positioned at each end of a consist, with each operator having a remote controller. The remote controllers are configured so that both remote controllers can cause the execution of safety functions of the locomotive but only one remote controller at a time controls control functions of the locomotive. To this end, depending on the movement of the consist, it is desirable for each remote controller to selectively assume exclusive control of the control functions of the locomotive while preserving the ability of both remote controllers to, at all times, control safety functions of a locomotive.

A problem with prior art remote/on-board controller configurations is that when a plurality of on-board controllers and a plurality of remote controllers are operating in the same geographical location, it is possible for radio frequency signals operating on the same frequency but issued by different controllers to collide thereby adversely affecting receipt of the signal and, therefore, any control to be effected thereby.

It is, therefore, desirable to overcome this problem and others by providing an improved remote locomotive control wherein radio frequency signal collisions are avoided. Still other desirable features of the invention will become apparent to those of ordinary skill in the art upon reading and understanding the following detailed description.

SUMMARY OF THE INVENTION

The invention is a locomotive control system that includes a global positioning module configured to receive a time reference signal output by a satellite. An on-board controller coupled to the global positioning module is responsive to the time reference signal for outputting a first polling signal at a time determined as a function of the time reference signal. A first remote controller is responsive to the first polling signal for outputting a first control signal during a first time interval. The on-board controller is responsive to the first control signal during the first time interval for controlling one or more functions of a locomotive.

The locomotive control system can also include a second remote controller responsive to a second polling signal output by the on-board controller after the first time interval at a time determined as a function of the time reference signal for outputting a second control signal during a second time interval. The on-board controller is responsive to the second control signal during the second time interval for controlling one or more functions of the locomotive.

The invention is also a locomotive control method that includes (a) outputting a first polling signal at a first time determined with reference to a signal output by a satellite; (b) in response to the first polling signal, outputting a first control signal from a first location during a first interval of time; (c) receiving the first control signal during the first interval of time; and (d) controlling one or more functions of a locomotive as a function of the received first control signal.

The locomotive control method can also include (e) after the first interval of time outputting a second polling signal at a second time determined with reference to the signal output by a satellite; (f) in response to the second polling signal, outputting a second control signal from a second location during a second interval of time; (g) receiving the second control signal during the second interval of time; and (h) controlling one or more functions of the locomotive as a function of the received second control signal.

Lastly, the invention is a locomotive control system that includes an on-board controller responsive to a time signal received from a remote source for outputting a first polling signal at a time determined with reference to said time signal. A first remote controller is responsive to the polling signal for outputting a first control signal during a first interval of time. The on-board controller is responsive to the first control signal output during the first interval of time for controlling one or more functions of the locomotive.

The locomotive control system can also include a second remote controller responsive to a second polling signal output by the on-board controller at a time after the first interval of time determined with reference to said time signal for outputting a second control signal during a second interval of time. The on-board controller is responsive to the second control signal during the second interval of time for controlling one or more functions of the locomotive.

DETAILED DESCRIPTION OF THE INVENTION

Figure 1:
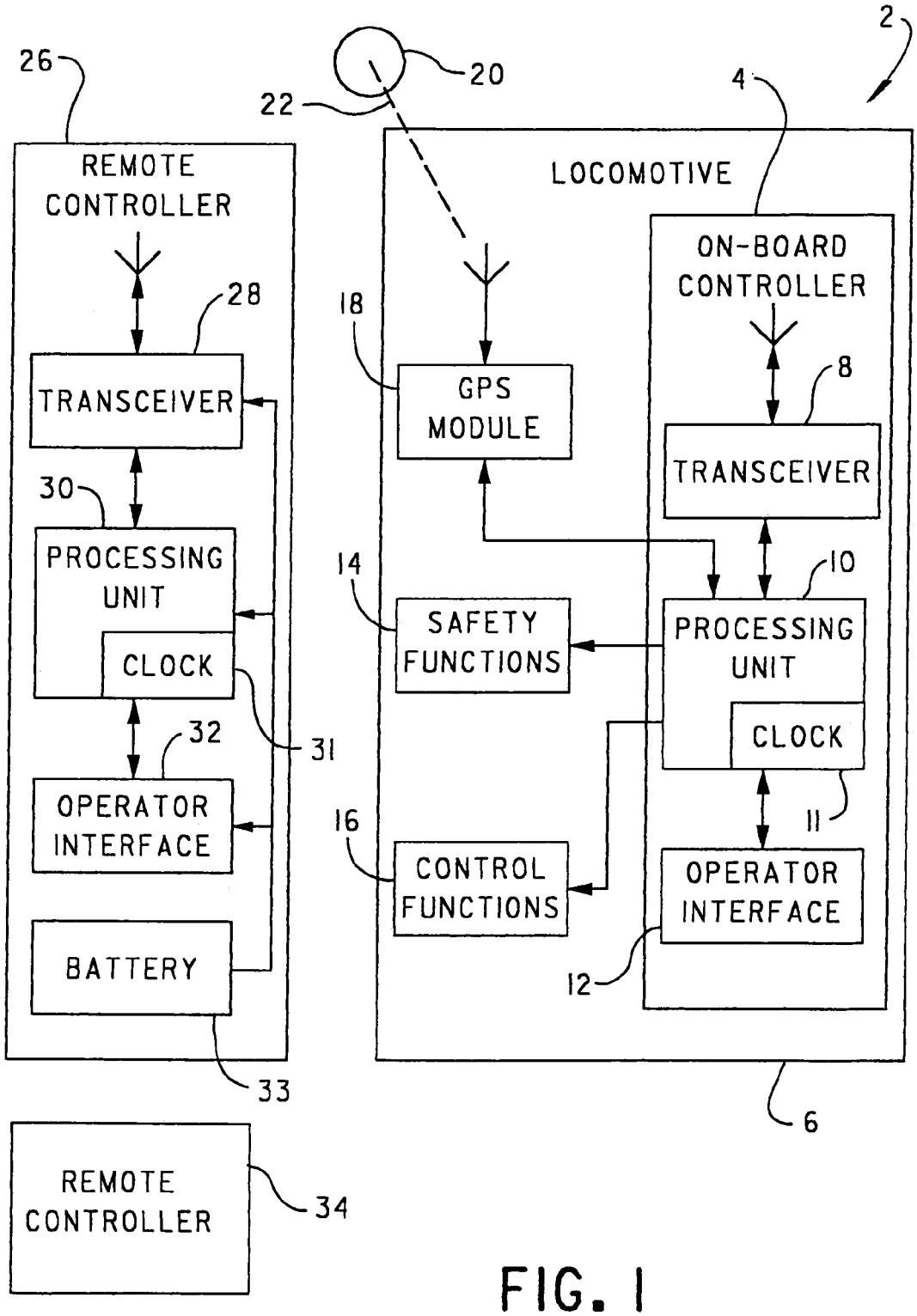
FIG. 1 is a block diagram of a locomotive control system that includes an on-board controller and two remote controllers that are configured to communicate with each other.

With reference to FIG. 1, a locomotive control system 2 includes an on-board controller 4 located on-board a locomotive 6. On-board controller 4 includes a transceiver 8 and an operator interface 12 operatively coupled to a processing unit 10 that includes a clock 11. Operator interface 12 is configured to control various safety functions 14 and control functions 16 of locomotive 6 in a manner to be described hereinafter. Non-limiting examples of safety functions include emergency shut down, tilt/man down, horn and bell.

Non-limiting examples of control functions include speed select, direction and brake level.

Locomotive control system 2 can also include a GPS module 18 located on-board locomotive 6 and coupled to processing unit 10. GPS module 18 is configured to receive from a satellite 20, among other things, a time reference signal 22. Time reference signal 22 can be utilized to set clock 11 of processing unit 10 with the current time of day in the time zone in which GPS module 18 resides.

Locomotive control system 2 also includes a remote controller 26 having a transceiver 28 and an operator interface 32 operatively coupled to a processing unit 30 that includes a clock 31 that operates without reference to time reference signal 22. Operator interface 32 includes control means, such as knobs, buttons, switches and the like (not shown). In response to user activation of one or more control means thereof, operator interface 32 outputs one or more corresponding data signals related to one or more functions of locomotive 6 to processing unit 30. These data signals can include analog data signals, digital data signals and combinations thereof. Processing unit 30 converts these one or more data signals into a control signal which is modulated onto a radio frequency signal that transceiver 28 transmits to on-board controller 4.

In response to receiving the radio frequency signal from remote controller 26, transceiver 8 demodulates the control signal therefrom and conveys the demodulated control signal to processing unit 10 which controls one or more safety functions 14 and/or control functions 16 of locomotive 6 as a function of the demodulated control signal.

Locomotive control system 2 can also include another remote controller 34, similar to remote controller 26, for transmitting to on-board controller 4 a radio frequency signal having modulated thereon a control signal corresponding to user activation of one or more control means of an operator interface (not shown) of remote controller 34. Remote controller 34 includes a slave transceiver, a processing unit and an operator interface which are not shown in FIG. 1 for simplicity of illustration.

To ensure integrity of communication between on-board controller 4 and each remote controller 26 and 34, on-board controller 4 and each remote controller 26 and 34 are assigned a unique data address that is programmed thereinto. In addition, on-board controller 4 is programmed with the data address of each remote controller 26 and 34 and each remote controller 26 and 34 is programmed with the data address of on-board controller 4.

At a suitable time determined with reference to time reference signal 22, on-board controller 4 outputs a radio frequency polling signal that includes the data address of remote controller 26. In response to receiving this polling signal, remote controller 26 demodulates its data address therefrom and conveys the demodulated data address to processing unit 30 for comparison with the data address of remote controller 26 programmed thereinto. In the event of a match between the data address programmed into remote controller 26 and the data address demodulated from the polling signal, remote controller 26, in response to user activation of one or more control means thereof, transmits a control signal to on-board controller 4. In response to successfully receiving this control signal from remote controller 26, on-board controller 4 controls one or more control functions 16 and/or safety functions 14 of locomotive 6 as a function of this control signal.

On-board controller 4 is configured to be responsive to control signals from remote controller 26 for a predetermined interval after transmitting the polling signal that includes the data address of remote controller 26. Similarly, remote controller 26 is configured to transmit control signals to on-board controller 4 only during this predetermined time interval. In the event on-board controller 4 does not receive a control signal from remote controller 26 within the predetermined interval after transmitting the polling signal, on-board controller 4 enters a safety state wherein the value of the speed select is set to zero and the brakes of the locomotive are fully applied.

After this predetermined time interval has expired, on-board controller 4 outputs another polling signal that includes the data address of remote controller 34. In response to receiving this polling signal, remote controller 34 demodulates its data address therefrom. Remote controller 34 then compares the demodulated data addresses to the corresponding data address stored therein. In the event of a match, remote controller 34, in response to user activation of one or more control means thereof, transmits a control signal to on-board controller 4. In response to receiving this control signal from remote controller 34, on-board controller 4 controls one or more control functions 16 and/or safety functions 14 of locomotive 6 as a function of this control signal.

On-board controller 4 is configured to be responsive to control signals from remote controller 34 for a predetermined time interval after transmitting the polling signal that includes data address of remote controller 34. Similarly, remote controller 34 is configured to transmit control signals to on-board controller 4 only during this predetermined time interval. In the event on-board controller 4 does not receive a control signal from remote controller 34 during the predetermined time interval, on-board controller 4 enters the safety state described above.

A benefit of utilizing time reference signal 22 is that each of a plurality of on-board controllers located on-board different locomotives operating in the same geographical location can be programmed to output polling signals to the remote controllers configured to communicate therewith at different times determined with reference to time reference signal 22.

Figure 2:
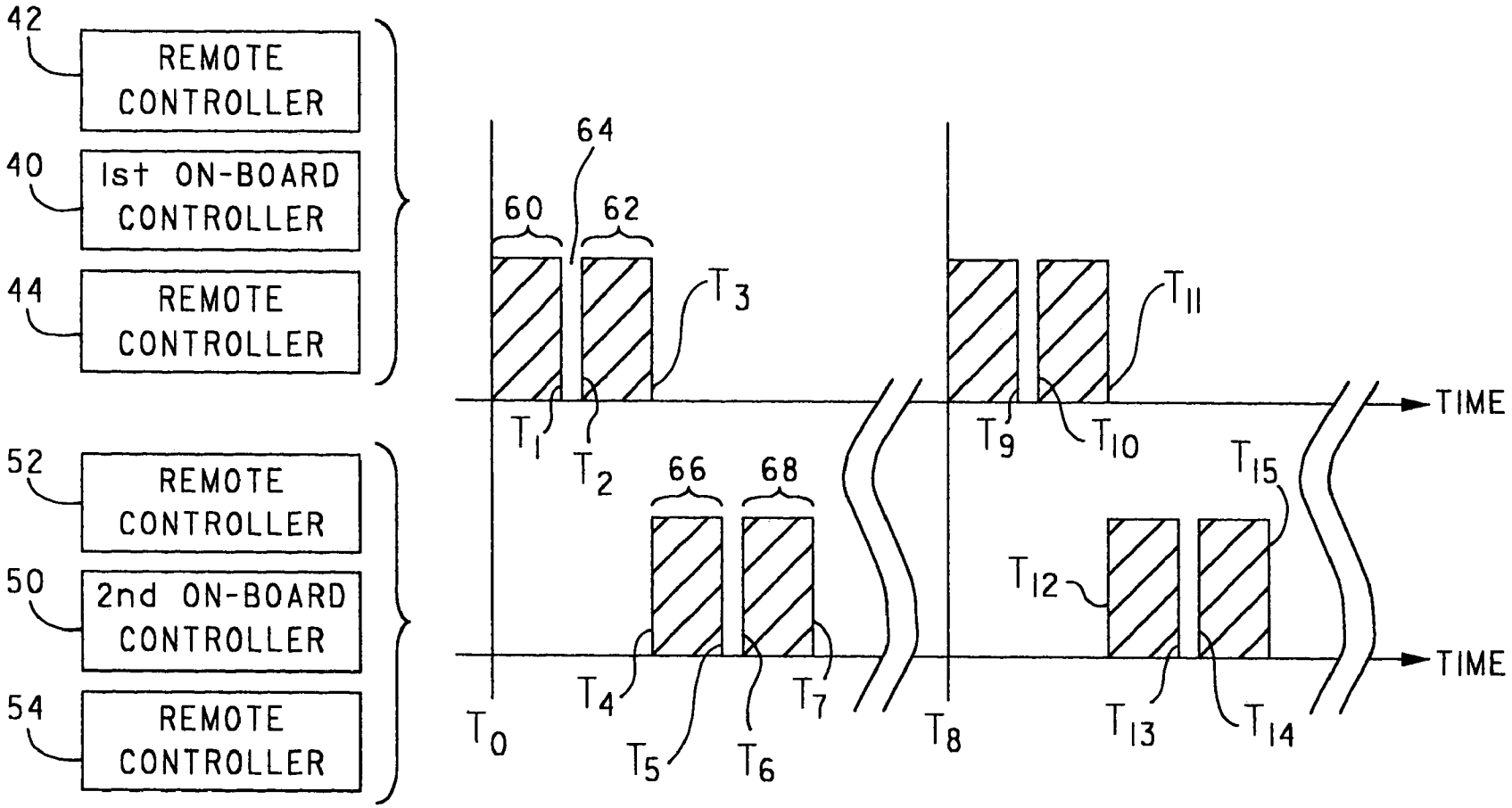
FIG. 2 is a block diagram of two groups of on-board controllers and corresponding remote controllers configured to communicate with each other and a timing diagram illustrating how the on-board controllers and corresponding remote controllers of each group of controllers communicate with each other to avoid interference therebetween.

For example, as shown in FIG. 2, suppose that a first on-board controller 40 having two remote controllers 42 and 44 configured to communicate with first on-board controller 40, and a second on-board controller 50 having two remote controllers 52 and 54 configured to communicate with second on-board controller 50 are provided. The number of on-board controllers and remote controllers, however, is not to be construed as limiting the invention.

In operation, at time $T_0$, first on-board controller 40 outputs a polling signal that includes the data address of remote controller 42. In response to receiving this polling signal and in response to user activation of one or more control means thereof, remote controller 42 outputs its control signal to first on-board controller 40. In response to receiving this control signal, first on-board controller 40 controls one or more safety functions 14 and/or control functions 16 of the corresponding locomotive as a function of the control signal.

After a predetermined time interval 60 ending at a time $T_1$, remote controller 42 terminates transmitting control signals to first on-board controller 40. Moreover, at the end of time interval 60, first on-board controller 40 terminates acting on control signals received from remote controller 42.

After time interval 60, at a time $T_2$ determined with reference to time reference signal 22, first on-board controller 40 outputs to remote controller 44 a polling signal that includes the data address of remote controller 44. In response to receiving this polling signal and in response to user activation of one or more control means thereof, remote controller 44 outputs its control signal to first on-board controller 40. In response to receiving this control signal, first on-board controller 40 controls one or more safety functions 14 and/or control functions 16 of the corresponding locomotive as a function of the control signal.

After a predetermined time interval 62 ending at a time $T_3$, remote controller 44 terminates transmitting control signals to first on-board controller 40. Moreover, at the end of time interval 62 first on-board controller 40 terminates acting on control signals received from remote controller 44.

As shown in FIG. 2, a guard interval 64 can be included between times $T_1$ and $T_2$. Since remote controllers 42 and 44 have clocks that operate without reference to time reference signal 22 and, therefore, can drift over time, guard interval 64 can be utilized to provide additional time for remote controller 42 to determine that it has reached the end of time interval 60 before first on-board controller 40 outputs to remote controller 44 the polling signal that includes the data address of remote controller 44. Other guard intervals (not shown) can also be included between other time intervals as needed to avoid similar problems.

After time interval 62, at a time $T_4$ determined with reference to time reference signal 22, second on-board controller 50 outputs to remote controller 52 a polling signal that includes the data address of remote controller 52. In response to receiving this polling signal and in response to user activation of one or more control means thereof, remote controller 52 outputs its control signal to second on-board controller 50. In response to receiving this control signal, second on-board controller 50 controls one or more safety functions 14 and/or control functions 16 of the corresponding locomotive as a function of the control signal.

After a predetermined time interval 66 ending at a time $T_5$, remote controller 52 terminates transmitting control signals to second on-board controller 50. Moreover, at the end of time interval 66 second on-board controller 50 terminates acting on control signals received from remote controller 52.

After time interval 66, at a time $T_6$ determined with reference to time reference signal 22, second on-board controller 50 outputs to remote controller 54 a polling signal that includes the data address of remote controller 54. In response to receiving this polling signal and in response to user activation of one or more control means thereof, remote controller 54 outputs its control signal to second on-board controller 50. In response to receiving this control signal, second on-board controller 50 controls one or more safety functions 14 and/or control functions 16 of the corresponding locomotive as a function of the control signal.

After a time interval 68 ending at a time $T_7$, remote controller 54 terminates transmitting control signals to second on-board controller 50. Moreover, at the end of time interval 68 second on-board controller 50 terminates acting on control signals received from remote controller 54.

Desirably, first on-board controller 40 is configured to output polling signals to remote controllers 42 and 44 at times $T_0$ and $T_2$ determined with reference to time reference signal 22 and second on-board controller 50 is configured to output polling signals to remote controllers 52 and 54 at times $T_4$ and $T_6$ determined with reference to time reference signal 22. More specifically, first and second on-board controllers 40 and 50 are programmed to output their polling signals at different times determined with reference to the time of day set in their respective clocks by time reference signal 22 received from satellite 20. In this manner, when a plurality of on-board controllers located on-board different locomotives operating in the same geographical region are being utilized, only one on-board controller and one remote controller are communicating at any time on the same frequency.

As shown in FIG. 2, the timing associated with the signals discussed above in connection with controllers 40—44 and 50—54 is repeated commencing at a time $T_8$. Since the timing associated with times $T_8$–$T_{15}$ in FIG. 2 is the same as the timing associated with times $T_0$–$T_7$, no description of the timing associated with times $T_8$–$T_{15}$ is included herein to avoid unnecessary redundancy.

As discussed above, times $T_0$, $T_2$, $T_8$ and $T_{10}$ when first on-board controller outputs its polling signals and times $T_4$, $T_6$, $T_{12}$ and $T_{14}$ when second on-board controller 50 outputs its polling signals is determined with reference to time reference signal 22 received from satellite 20. For example, first on-board controller 40 can be configured to output polling signals to remote controller 42 at times $T_0$ and $T_8$ every five seconds as determined by the clock of first on-board controller 40. Moreover, first on-board controller 40 can be programmed to output polling signals to remote controller 44 at times $T_2$ and $T_{10}$ a predetermined time interval, e.g., one second, after outputting the polling signals at times $T_0$ and $T_8$, respectively.

Furthermore, second on-board controller 50 can be programmed to output polling signals to remote controller 52 at times $T_4$ and $T_{12}$ a predetermined time interval, e.g., two seconds, after times $T_0$ and $T_8$. Finally, second on-board controller 50 can be programmed to output polling signals to remote controller 54 at times $T_6$ and $T_{14}$ a predetermined time interval, e.g., three seconds, after times $T_0$ and $T_8$.

Since the clocks of first and second on-board controllers 40 and 50 are set with reference to time reference signal 22 received from satellite 20, the clocks of first and second on-board controllers 40 and 50 should be set to the substantially same time for the purpose of determining when to output their respective polling signals. Because it is possible for the clocks of first and second on-board controllers 40 and 50 to drift over time, however, it is desirable that the time reference signal 22 update these clocks regularly.

Because it is possible that the GPS modules providing the time reference signals to first and second on-board controllers 40 and 50 may not be able to receive time reference signal 22 from satellite 20 for various reasons, e.g., no direct line of sight between a GPS module and satellite 20, a guard interval of time can be provided between times $T_3$ and $T_4$, and times $T_{11}$ and $T_{12}$ to avoid second on-board controller 50 from outputting a polling signal when remote controller 44 and first on-board controller 40 are in communication.

Because the clocks of remote controllers 42, 44, 52 and 54 are not set by time reference signal 22, the actual time set in the clock of each remote controller 42, 44, 52 and 54 can be different and can drift with respect to each other over time. However, these clocks are sufficiently accurate to enable each remote controller to communicate with the corresponding on-board controller after receipt of the polling signal only during the corresponding time interval 60, 62, 66 and 68.

In the foregoing discussion in connection with FIG. 2, it was assumed that all communications between each group of controllers, namely, groups 40, 42 and 44, and groups 50, 52 and 54, occurred on the same frequency. Use of the same frequency to effect communications between additional groups of controllers can continue by simply allocating a different time interval for each group of controllers to communicate with each other. However, it is desirable that a user of each remote controller perceive substantially real time response to user activation of any control means thereof. To this end, if the number of groups of controllers utilized in a given geographical location increases to the point where this substantially real time control is compromised, the group of controllers can be separated into two or more subgroups that communicate on different frequencies. For example, if ten groups of controllers are being utilized at a given geographical location, five subgroups of these controllers can be configured to operate on one frequency while the other five subgroups of these controllers can be configured to operate on another frequency.

Desirably, each on-board controller is configured so that only one remote controller at a time can assume exclusive control of the control functions of the locomotive while, at all times, all of the remote controllers configured to communicate with the on-board controller can control the safety functions of the locomotive. To this end, the on-board controller can be configured to enable control of the control functions of the locomotive to be assumed by any of the remote controllers configured to communicate with the on-board controller on a first-come first-serve basis when no remote controller is currently controlling the control functions of the locomotive. The on-board controller can also be configured so that a user of each remote controller can relinquish control of the locomotive when desired thereby enabling the user of another remote controller configured to communicate with the on-board controller to assume exclusive control of the control functions of the locomotive. An example of such a system suitable for this purpose is disclosed in U.S. patent application Ser. No. 10/222,376, filed Aug. 16, 2002, which is expressly incorporated herein by reference. However, this incorporation by reference is not to be construed as limiting the invention since any suitable system that enables only one remote controller at a time to assume exclusive control over the control functions of the locomotive on a first-come first-serve basis, a user of each remote controller to relinquish control of the control functions of the locomotive when desired and all of the remote controllers, at all times, to control safety functions of the locomotive is envisioned.

As can be seen, the present invention enables multiple on-board controllers and the remote controllers configured to communicate with each on-board controller to communicate with each other without interference. While each on-board controller was described as being configured to communicate with two remote controllers, it is to be appreciated that only one remote controller can be used with an on-board controller if desired. Similarly, if the use of three or more remote controllers with a given on-board controller is desired, the time that each on-board controller operating in a geographical location outputs its polling signals can be adjusted as needed. Lastly, the GPS module associated with each on-board controller can also receive geographical location information from satellite 20 whereupon this geographical location information can be utilized by the on-board controller to limit the selection of the frequencies being utilized for communications with its corresponding remote controllers to those frequencies licensed to the geographical location.

The invention has been described with reference to the preferred embodiments. Obvious modifications and alterations will occur to others upon reading and understanding the preceding detailed description. It is intended that the invention be construed as including all such modifications and alterations insofar as they come within the scope of the appended claims or the equivalents thereof.

The invention claimed is:

1. A locomotive control system comprising:

a global positioning module positioned on-board a locomotive and configured to receive a time reference signal output by satellite;

an on-board controller positioned on-board the locomotive, the on-board controller coupled to the global positioning module and responsive to the time reference signal for outputting a first polling signal at a time determined as a function of the time reference signal; and a first remote controller responsive to the first polling signal for outputting a first control signal during a first time interval, the on-board controller responsive to the first control signal during the first time interval for controlling one or more functions of the locomotives wherein the function(s) of the locomotive being controlled by the first control signal include at least one of emergency shutdown, tilt/man-down, horn, bell, speed select, direction and brake level.

2. A locomotive control system comprising:

a global positioning module positioned on-board a locomotive and configured to receive a time reference signal output by satellite;

an on-board controller positioned on-board the locomotive, the on-board controller coupled to the global positioning module and responsive to the time reference signal for outputting a first polling signal at a time determined as a function of the time reference signal;

a first remote controller responsive to the first polling signal for outputting a first control signal during a first time interval, the on-board controller responsive to the first control signal during the first time interval for controlling one or more functions of the locomotive; and a second remote controller responsive to a second polling signal output by the on-board controller after the first time interval at a time determined as a function of the time reference signal for outputting a second control signal during a second time interval, wherein the on-board controller is responsive to the second control signal during the second time interval for controlling one or more functions of the locomotive.

3. The locomotive control system of claim 2, wherein the on-board controller outputs at least one of the first and second time intervals periodically.

4. The locomotive control system of claim 2, wherein:

the on-board controller includes a data address of the first and second remote controllers on the respective first and second polling signals; and the first and second remote controllers are responsive to their respective data addresses included on the first and second polling signals for outputting the first and second control signals during the first and second time intervals, respectively.

5. The locomotive control system of claim 2, wherein:

each remote controller includes its data address on its control signal; and the on-board controller is responsive to the data address included on each control signal for controlling the one or more functions of a locomotive during the corresponding time interval.

6. The locomotive control system of claim 2, wherein each polling signal and each control signal is a radio frequency signal.

7. The locomotive control system of claim 6, wherein a frequency of each radio frequency signal is determined from a signal received by the global positioning module from the satellite.

8. A locomotive control method comprising:

(a) outputting a first polling signal from a locomotive at a first time determined with reference to a signal output by a satellite which is received by the locomotive;

(b) in response to the first polling signal, outputting a first control signal from a first location during a first interval of time;

(c) receiving the first control signal during the first interval of time; and (d) controlling one or more functions of the locomotive as a function of the received first control signal, wherein the function(s) of the locomotive being controlled by the first control signal include at least one of emergency shutdown, tilt/man-down, horn, bell, speed select, direction and brake level.

9. A locomotive control method comprising:

(a) outputting a first polling signal from a locomotive at a first time determined with reference to a signal output by a satellite which is received by the locomotive;

(b) in response to the first polling signal, outputting a first control signal from a first location during a first interval of time;

(c) receiving the first control signal during the first interval of time;

(d) controlling one or more functions of the locomotive as a function of the received first control signal;

(e) after the first interval of time, outputting a second polling signal from the locomotive at a second time determined with reference to the signal output by a satellite;

(f) in response to the second polling signal, outputting a second control signal from a second location during a second interval of time;

(g) receiving the second control signal during the second interval of time; and (h) controlling one or more functions of the locomotive as a function of the received second control signal.

10. The locomotive control method of claim 9, wherein:

the first and second control signals are received by an on-board controller positioned on-board the locomotive;

the first control signal is output from a first remote controller positioned remote from the locomotive; and the second control signal is output from a second remote controller positioned remote from the locomotive.

11. The locomotive control method of claim 9, wherein a frequency of at least one of the first polling signal, second polling signal, the first control signal and the second control signal is selected as a function of another signal output by the satellite.

12. The locomotive control method of claim 9, wherein each interval of time repeats periodically.

13. A locomotive control system comprising:

an on-board controller positioned on a locomotive and responsive to a time signal received wirelessly from a remote source for outputting a first wireless polling signal at a time determined with reference to the time signal; and a first remote controller responsive to the polling signal for outputting a first control signal during a first interval of time, wherein the on-board controller is responsive to the first control signal output during the first interval of time for controlling one or more functions of a locomotive, wherein the function(s) of the locomotive being controlled by the first control signal include at least one of emergency shutdown, tilt/man-down, horn, bell, speed select, direction and brake level.

14. A locomotive control system comprising:

an on-board controller positioned on a locomotive and responsive to a time signal received wirelessly from a remote source for outputting a first wireless polling signal at a time determined with reference to the time signal;

a first remote controller responsive to the polling signal for outputting a first control signal during a first interval of time, wherein the on-board controller is responsive to the first control signal output during the first interval of time for controlling one or more functions of a locomotive; and a second remote controller responsive to a second polling signal output by the on-board controller at a time after the first interval of time determined with reference to the time signal for outputting a second control signal during a second interval of time, wherein the on-board controller is responsive to the second control signal during the second interval of time for controlling one or more functions of the locomotive.

15. The locomotive control system of claim 14, wherein:

the on-board controller includes a data address of the first and second remote controllers on the respective first and second polling signals; and the first and second remote controllers are responsive to their respective data addresses included on the first and second polling signals for outputting the first and second control signals during the first and second intervals of time, respectively.

16. The locomotive control system of claim 14, wherein:

each remote controller includes its data address on its control signal; and the on-board controller is responsive to the data address included on each control signal for controlling the one or more functions of a locomotive during the corresponding interval of time.

17. The locomotive control system of claim 14, wherein each polling signal and each control signal is a radio frequency signal.

18. The locomotive control system of claim 17, wherein a frequency of each radio frequency signal is determined from a signal received by the on-board controller from the remote source.

19. The locomotive control system of claim 14, wherein each interval of time repeats periodically.

* * * * *

UNITED STATES PATENT AND TRADEMARK OFFICE

CERTIFICATE OF CORRECTION

PATENT NO. : 7,069,122 B1
APPLICATION NO. : 10/383308
DATED : June 27, 2006
INVENTOR(S) : David B. Higgs It is certified that error appears in the above-identified patent and that said Letters Patent is hereby corrected as shown below:

Column 8, Line 16, Claim 1, "of the locomotives" should read -- of the locomotive, --

Signed and Sealed this

Twenty-first Day of November, 2006

JON W. DUDAS
*Director of the United States Patent and Trademark Office*